US007819069B2

(12) United States Patent
Tanaka et al.

(10) Patent No.: US 7,819,069 B2
(45) Date of Patent: Oct. 26, 2010

(54) SHOWCASE

(75) Inventors: Tsutomu Tanaka, Ota (JP); Masafumi Sakaguchi, Gunma-ken (JP); Tomohiro Okubo, Kumagaya (JP); Yasuhiko Hayashi, Kumagaya (JP); Masahiko Nagatake, Gunma-ken (JP)

(73) Assignee: Sanyo Electric Co., Ltd., Moriguchi-shi (JP)

( * ) Notice: Subject to any disclaimer, the term of this patent is extended or adjusted under 35 U.S.C. 154(b) by 397 days.

(21) Appl. No.: 11/707,096

(22) Filed: Feb. 16, 2007

(65) Prior Publication Data

US 2007/0193480 A1 Aug. 23, 2007

(30) Foreign Application Priority Data

Feb. 22, 2006 (JP) ..... 2006-045342

(51) Int. Cl.
*A47B 57/00* (2006.01)
*A47B 9/00* (2006.01)
*A47F 3/04* (2006.01)

(52) U.S. Cl. ..... 108/64; 108/108; 108/92; 312/116

(58) Field of Classification Search ..... 108/106, 108/107, 108, 147.17, 65, 27; 211/134, 186, 211/189; 312/116, 140.3, 238; 52/36.4, 52/36.5, 716.1; 248/220.31, 220.41, 220.42, 248/235, 239, 241, 247, 248, 250; 40/642.02, 40/649, 650–654, 654.01
See application file for complete search history.

(56) References Cited

U.S. PATENT DOCUMENTS 450,289 A * 4/1891 Gottfried ..... 108/106
1,872,053 A * 8/1932 Zimmerman ..... 40/650
2,072,700 A * 3/1937 Bales ..... 108/101
2,191,701 A * 2/1940 Wood ..... 248/245
D140,249 S * 2/1945 Christopher ..... D6/437
D149,381 S * 4/1948 Schick ..... D6/437
2,653,783 A * 9/1953 Lindsay ..... 248/243
2,822,672 A * 2/1958 Dickson et al. ..... 62/125
2,936,904 A * 5/1960 Streater ..... 108/28
3,219,401 A * 11/1965 Mapson ..... 312/140.3
D212,399 S * 10/1968 Kimler et al. ..... D6/437
3,876,263 A * 4/1975 Oleksiak ..... 384/21

(Continued)

FOREIGN PATENT DOCUMENTS

JP 2001-8799 1/2001

*Primary Examiner*—Janet M Wilkens
*Assistant Examiner*—Timothy M Ayres
(74) *Attorney, Agent, or Firm*—Kratz, Quintos & Hanson, LLP

(57) ABSTRACT

A showcase has shelf devices in a chamber having a plurality of open surfaces, a pair of shelf support members which extend in a depth direction of the chamber supporting the shelves in a position where adjacent shelves are butted with each other. A support member side portion protrudes from a lower portion of one shelf support member to another shelf support member, a support member side portion protrudes from a lower portion of the other shelf support member to the one shelf support member and superimposed on the support member side portion, a shelf side portion has bottom side superimposed on the support member side portion, a shelf side portion formed under the adjacent shelf has a bottom side superimposed on the shelf side portion, and a bonding member detachably bonds the support side portions and shelf side portions in a superimposed position.

3 Claims, 9 Drawing Sheets

U.S. PATENT DOCUMENTS 4,760,930 A * 8/1988 Fox ..... 211/153
4,777,806 A * 10/1988 Perez ..... 62/256
4,812,075 A * 3/1989 Lavin, Sr. ..... 403/403
5,405,114 A * 4/1995 Dias ..... 248/250
D367,777 S * 3/1996 Arnone ..... D6/436
5,531,159 A * 7/1996 Stubblefield ..... 108/102
5,645,257 A * 7/1997 Ward ..... 248/245
6,019,331 A * 2/2000 Hoogland et al. ..... 248/250
6,035,569 A * 3/2000 Nagel et al. ..... 40/661.03
6,189,707 B1 * 2/2001 Meyers et al. ..... 211/90.04
6,202,966 B1 * 3/2001 MacDonald et al. ..... 248/243
6,622,410 B2 * 9/2003 Wilkes et al. ..... 40/654
6,626,407 B1 * 9/2003 Miller et al. ..... 248/250
7,140,500 B2 * 11/2006 McCoy ..... 211/60.1
2004/0206714 A1 * 10/2004 Jablow et al. ..... 211/153
2004/0250459 A1 * 12/2004 Brinkman et al. ..... 40/642.02
2004/0250485 A1 * 12/2004 Pulte ..... 52/198
2005/0109901 A1 * 5/2005 Stitchick et al. ..... 248/235
2006/0046021 A1 * 3/2006 Morris ..... 428/99
2006/0243636 A1 * 11/2006 Robichaud et al. ..... 206/586
2007/0094996 A1 * 5/2007 Young ..... 52/716.1

* cited by examiner

SHOWCASE

BACKGROUND OF THE INVENTION

The present invention relates to a showcase including a chamber having a plurality of open surfaces, more particularly to a shelf device installed in the chamber.

Heretofore, a showcase including shelves in a chamber having a plurality of open surfaces, for example, two to four open surfaces has been used in displaying refrigerated foods, fresh foods and the like in a store such as a supermarket. In such a showcase, a vertical structure including ducts is usually disposed on a base including a cooling device, and back plates are attached to four surfaces of the vertical structure. Moreover, display shelves are installed on the four surfaces of this vertical structure. These display shelves are detachably attached to the back plates, and supported at an adjustable angle by shelf support members extending in a depth direction.

When the display shelf is disposed in a corner portion, an end side of the shelf on a corner portion side is formed into an inclined plane shape. A side flange of one display shelf on an inclined side is butted with a side flange of another display shelf on the inclined side. Moreover, the side flanges constituting the display shelves are held by the shelf support members which support the display shelves from below. One place of each flange closer to a distal end than to the center is held and fixed by a bolt and a nut from opposite sides.

However, according to such a shelf constitution, an operation of fixing the side flange of the shelf by use of a tool from the opposite side of the flange has to be performed under the shelf, and there has been a problem of a laborious operation. In view of operability, the fixing of the flanges by use of the bolts and the nuts is performed at the distal end of each shelf. Therefore, there are problems that a rear end of a shelf plate and a rear end of the shelf support member easily move upwards centering on the fixed portion as an axis and that the shelf support members fall from engagement holes formed in the back plates. If commodities on the shelf are mounted on a front part of the shelf plate in a concentrated manner, a load is concentrated on the distal end of the shelf plate, the rear end of the shelf plate therefore moves upwards, the shelf support member disengages from the engagement hole of the back plate, and the shelf support member falls together with the shelf.

To solve the problems, as disclosed in, for example, Japanese Patent Application Laid-Open No. 2001-8799, a fixing method is developed in which superimposed portions bent in one direction are formed on the butted side flanges of the shelf plates, a superimposed portion bent in a similar direction is also formed at the distal end of the shelf support member sandwiched between the side flanges, and these superimposed portions are tightened with screws in a superimposed state.

However, in the above shelf fixing method, when the superimposed portion of the side flange of each shelf plate is simply superimposed on the superimposed portion of the shelf support member, each shelf plate is not stably held by the shelf support member, and the shelf plate is brought into an unstable state until both the shelf plate and the shelf support member are fixed via the screws. On the other hand, a side flange of the shelf plate to be fixed, which is positioned on an opposite side, also needs to be fixed to a side flange of another shelf plate. In a case where one flange is independently fixed, when the other flange is fixed, there is a disadvantage that the superimposed portions cannot be superimposed and that the flanges cannot be fixed. Therefore, a fixing operation has to be performed while butted portions of the shelves constituting all the corner portions are generally judged, and there is a problem that the operation becomes laborious.

Moreover, shapes of the shelves of the corner portions are formed so that the side flanges of the shelf plates are butted to form the shelf corner portions. Therefore, a dimensional error is easily generated. During attaching, it is difficult to appropriately form the corner portions without generating any deviation.

Furthermore, a shelf decoration is attached to a front flange formed on each shelf plate. The decoration has a shelf plate decorating function, and a display card is attached to the decoration. On the display card, a price, a product name and the like of each displayed commodity are displayed. Moreover, a corner decoration positioned between the shelf decorations is attached to a distal end of a butted portion of the shelf constituting the corner portion.

However, the corner decoration is constituted so as to cover mutually butted end portions of adjacent shelf decorations, and the corner decoration is attached by inserting the corner decoration into the end portion of the shelf decoration. Therefore, when an operation to put the commodities on or away from the shelves is performed, there is a problem that an operator's sleeve or the like is caught by the corner decoration, and the decoration easily falls. There is also a problem that the corner decoration falls from the shelf decoration owing to an impact applied to the shelf decoration or the like.

SUMMARY OF THE INVENTION

In consequence, the present invention has been developed to solve a conventional technical problem, and an object thereof is to provide a showcase in which shelves can stably be installed and in which improvements of display performance and appearance can be realized.

A first invention of the present application is directed to a showcase provided with shelves in a chamber having a plurality of open surfaces, comprising: a pair of adjacent shelf support members which extend in a depth direction of the chamber and which support the shelves in a position where the adjacent shelves are butted with each other, respectively; a first support member side superimposed portion which protrudes from a lower portion of one shelf support member to the other shelf support member; a second support member side superimposed portion which protrudes from a lower portion of the other shelf support member to the one shelf support member and which is superimposed on the first support member side superimposed portion; a first shelf side superimposed portion which is formed into a stage from an edge portion of one of the adjacent shelves in the form of stairs and which has a bottom side superimposed on the second support member side superimposed portion; a second shelf side superimposed portion which is turned downwards from an edge portion of the other adjacent shelf and which has a bottom side superimposed on the first shelf side superimposed portion; and a bonding member to detachably bond all the superimposed portions in a state in which the superimposed portions are superimposed.

The showcase of a second invention is characterized in that in the above invention, one shelf support member supports the other shelf, and the other shelf support member supports the one shelf.

The showcase of a third invention is characterized in that in the above inventions, the superimposed portions are constituted at front portions of the shelves and the shelf support members.

A fourth invention is directed to a showcase provided with shelves in a chamber having a plurality of open surfaces, comprising: a shelf decoration attached to a front end portion of each shelf; and a corner decoration which is positioned at a corner portion where the adjacent shelves are butted with each other and which is disposed between the adjacent shelf decorations, wherein an extending portion which extends toward the other shelf to constitute the corner portion is formed at a butted side distal end portion of one of the adjacent shelves, and the corner decoration is attached to the extending portion.

According to the first invention, the showcase provided with the shelves in the chamber having the plurality of open surfaces comprises: the pair of adjacent shelf support members which extend in the depth direction of the chamber and which support the shelves in the position where the adjacent shelves are butted with each other, respectively; the first support member side superimposed portion which protrudes from the lower portion of one shelf support member to the other shelf support member; the second support member side superimposed portion which protrudes from the lower portion of the other shelf support member to the one shelf support member and which is superimposed on the first support member side superimposed portion; the first shelf side superimposed portion which is formed into the stage from the edge portion of one of the adjacent shelves in the form of stairs and which has the bottom side superimposed on the second support member side superimposed portion; the second shelf side superimposed portion which is turned downwards from the edge portion of the other adjacent shelf and which has the bottom side superimposed on the first shelf side superimposed portion; and the bonding member to detachably bond all the superimposed portions in the state in which the superimposed portions are superimposed. Therefore, when the shelf side superimposed portion formed at an end portion of each shelf is simply mounted on the support member side superimposed portion formed on the shelf support member supporting each shelf, each shelf is stably supported by the shelf support members. Therefore, the shelves can stably be installed, and it is possible to avoid a disadvantage that the shelves easily fall. In consequence, reliability of the shelf can be improved.

Moreover, since the support member side superimposed portions are mounted on each other and the shelf side superimposed portions are further mounted on the support member side superimposed portions to bond the shelves and the support members, positioning and attaching/detaching are facilitated. Especially, since the superimposed portions constituted by superimposing the superimposed portions on one another are covered with the second shelf side superimposed portion of the other shelf, a corner portion formed by the first and second shelves can be flattened. In consequence, improvements of display performance and appearance can be realized.

Furthermore, all of the support member side superimposed portions and the shelf side superimposed portions are detachably bonded with the bonding member in a state in which the superimposed portions are superimposed one another. In consequence, the shelves can more stably and securely be installed.

According to the second invention, in the above invention, the one shelf support member supports the other shelf, and the other shelf support member supports the one shelf. Therefore, when the first shelf side superimposed portion of the one shelf is superimposed on the second support member side superimposed portion of the other shelf support member, the other shelf support member and the one shelf including the superimposed portions can be brought into close contact with each other. The shelves can further stably be installed.

According to the third invention, in the above inventions, the superimposed portions are constituted at the front portions of the shelves and the shelf support members. Therefore, a bonding operation by use of the bonding member can easily be performed.

According to the fourth invention, the showcase provided with the shelves in the chamber having the plurality of open surfaces comprises: the shelf decoration attached to the front end portion of each shelf; and the corner decoration which is positioned at the corner portion where the adjacent shelves are butted with each other and which is disposed between the adjacent shelf decorations. The extending portion which extends toward the other shelf to constitute the corner portion is formed at the butted side distal end portion of one of the adjacent shelves. Therefore, as compared with a case where two shelves are butted to thereby constitute the corner portion at a distal end portion, in a case where the corner portion is constituted of the extending portion formed on one shelf, a dimensional error is not easily generated, and the shelves can stably be installed.

Moreover, the corner decoration is attached to the extending portion formed on one shelf. Therefore, as compared with a conventional case where two shelves are butted with each other to thereby constitute the corner portion at the distal end portion and the corner decoration is attached to the corner portion, the corner decoration can stably be attached. In consequence, if those who move in the vicinity of the shelves come into contact with the corner decorations, the corner decorations do not easily fall. It is possible to inhibit a disadvantage that the corner decorations are lost.

DETAILED DESCRIPTION OF THE PREFERRED EMBODIMENT

Figure 1:
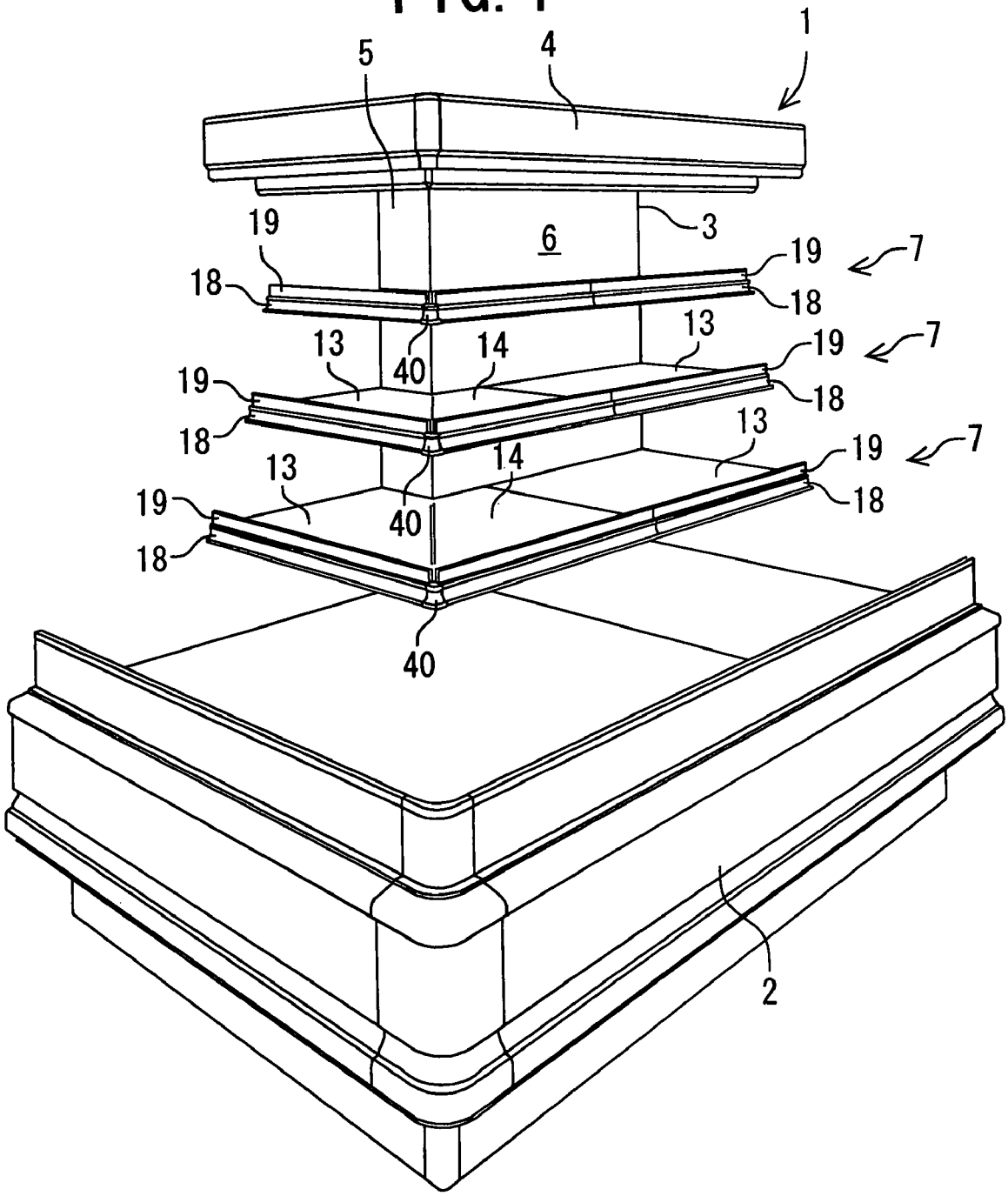
FIG. 1 is a perspective view of the whole showcase to which the present invention is applied.
Figure 2:
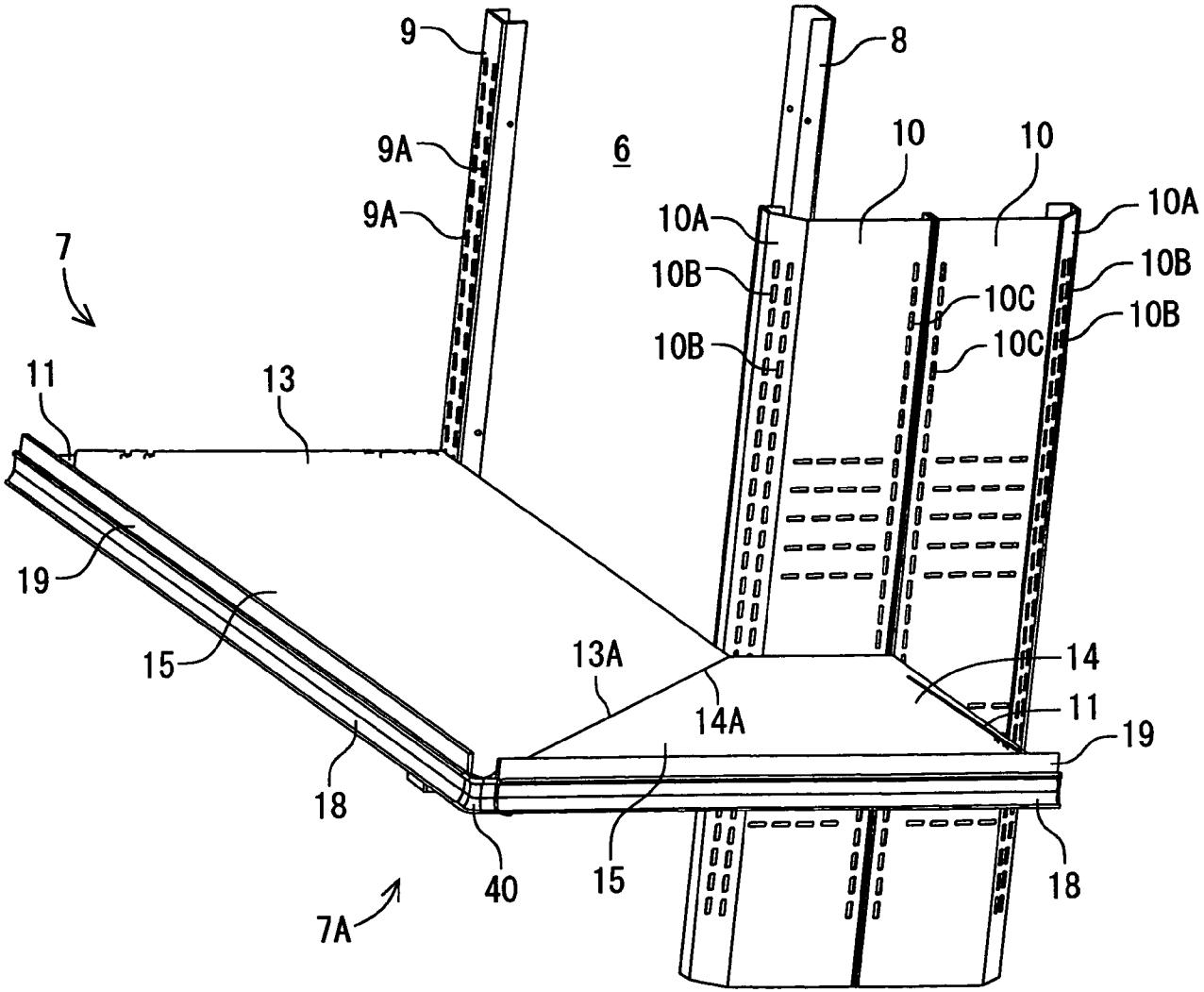
FIG. 2 is an enlarged perspective view of a shelf device, showing an installed state of the shelf device.

Next, an embodiment of the present invention will be described in detail with reference to the drawings. FIG. 1 is the whole perspective view of a showcase 1 to which the present invention is applied, and FIG. 2 is an enlarged perspective view of a shelf device 7, showing an installed state of the shelf device 7. The showcase 1 of the embodiment is for use in displaying and selling frozen foods and fresh foods in a store such as a supermarket, and at least two to four adjacent surfaces are open as shown in FIG. 1.

In this showcase 1, a main body 5 is constituted of a base 2 in which a cooling device is disposed; a vertical structure 3 substantially disposed in the center of this base 2 and including a duct; and a canopy-like top plate 4 disposed at an upper part of this vertical structure 3 and including a discharge port of cool air. A showroom 6 for displaying commodities is formed in a space surrounded with the base 2, the vertical structure 3 and the top plate 4.

As shown in FIG. 2, a plurality of supports 8, 9 are attached to an outer surface of the vertical structure 3 constituting the main body 5 over a vertical direction. Since the showcase 1 of the present embodiment is formed into a flat rectangular shape, the supports 8 are vertically arranged at corner portions of the vertical structure 3, and the supports 9 are further vertically arranged on the outer surface of the vertical structure 3 extending in a longitudinal direction. In an outer surface of this support 9, a plurality of engagement holes 9A are made at predetermined intervals over the vertical direction. Each engagement hole 9A is formed into an elongated shape which is vertically long, and the hole is disengageably engageable with an engagement claw 12 formed at a rear end of a shelf support member 11 constituting the shelf device 7 described later.

Back plates 10 formed along outer surfaces of the vertical structure 3 are attached to the supports 8 vertically arranged at the corner portions. At a position of each back plate 10 corresponding to the corner portion of the vertical structure 3, that is, the outer surface of the support 8, a corner attachment surface 10A is formed by bending the corner attachment surface at a predetermined angle so that the corner attachment surface faces a corner portion 7A formed at an outer end of the shelf device 7 installed at the back plate 10. Moreover, in each corner attachment surface 10A, at least two rows of a plurality of engagement holes 10B made at predetermined intervals are arranged over the vertical direction. In the present embodiment, one surface of the vertical structure 3 is surrounded with at least two back plates 10. In an end portion of the back plate 10 on a side opposite to a side on which the corner attachment surface 10A is formed, a plurality of engagement holes 10C are similarly made at predetermined intervals over the vertical direction. The engagement holes 10B, 10C are formed into elongated shapes which are vertically long, and the holes are disengageably engageable with the engagement claws 12 at the rear end of the shelf support member 11 and engagement claws 20A, 30A formed at rear ends of shelf support members 20, 30 constituting the shelf device described later in the same manner as in the above engagement holes 9A.

Moreover, a plurality of shelf devices 7 are engaged with the back plates 10 supported by these supports 8, 9 to thereby install a plurality of stages of shelf devices 7 in the showroom 6.

Figure 3:
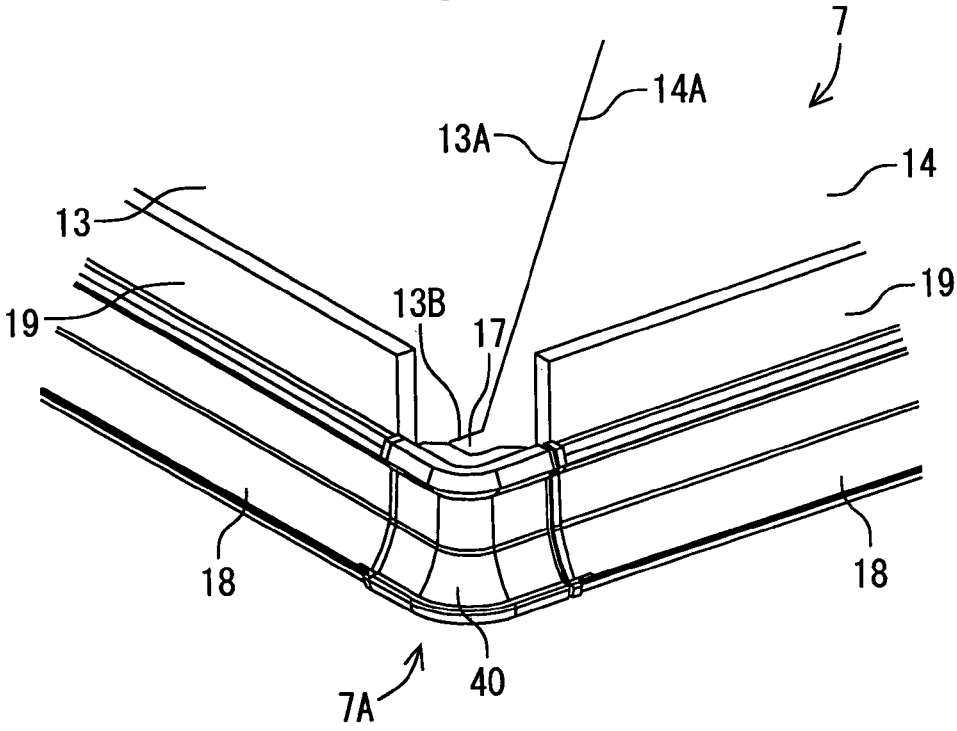
FIG. 3 is a partially enlarged perspective view of a corner portion of the shelf device.
Figure 4:
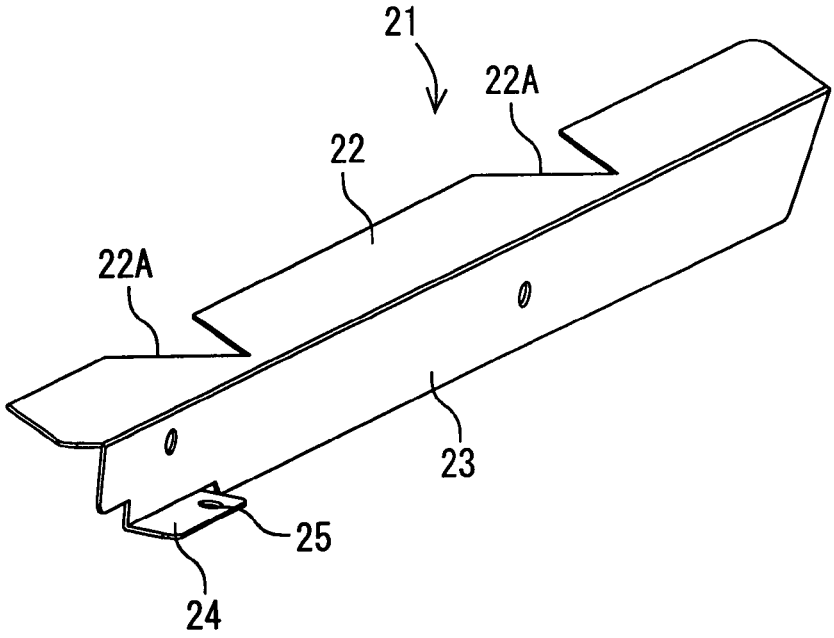
FIG. 4 is a perspective view of a first shelf side plate.
Figure 5:
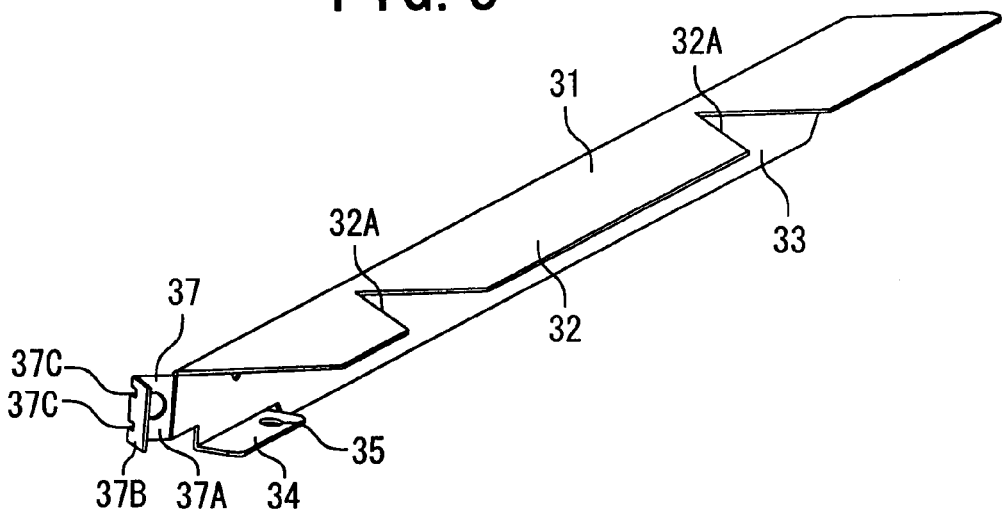
FIG. 5 is a perspective view of a second shelf side plate.
Figure 6:
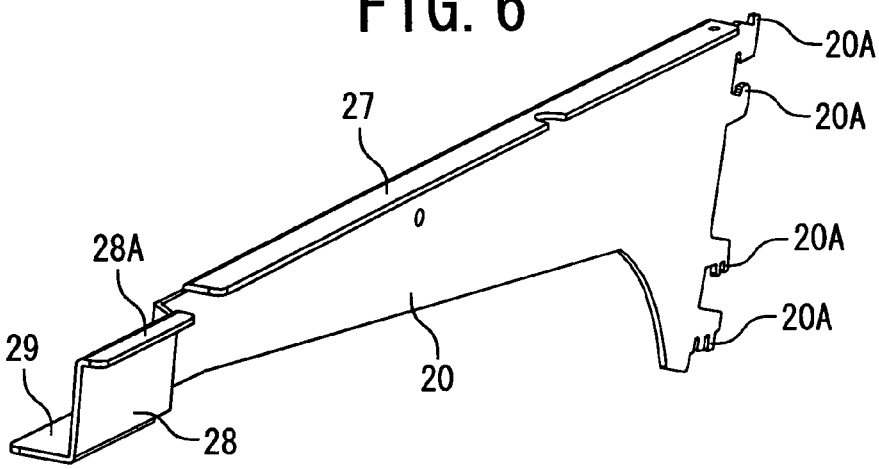
FIG. 6 is a perspective view of a first shelf support member.
Figure 7:
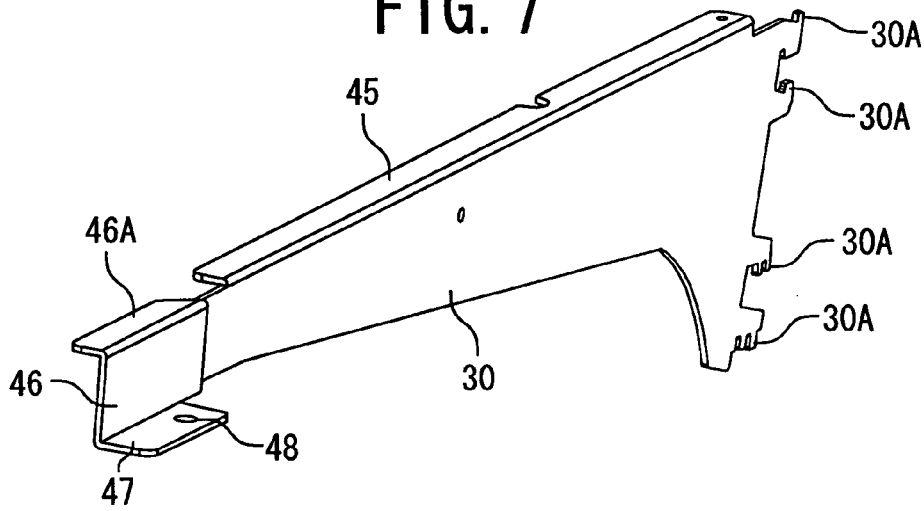
FIG. 7 is a perspective view of a second shelf support member.
Figure 8:
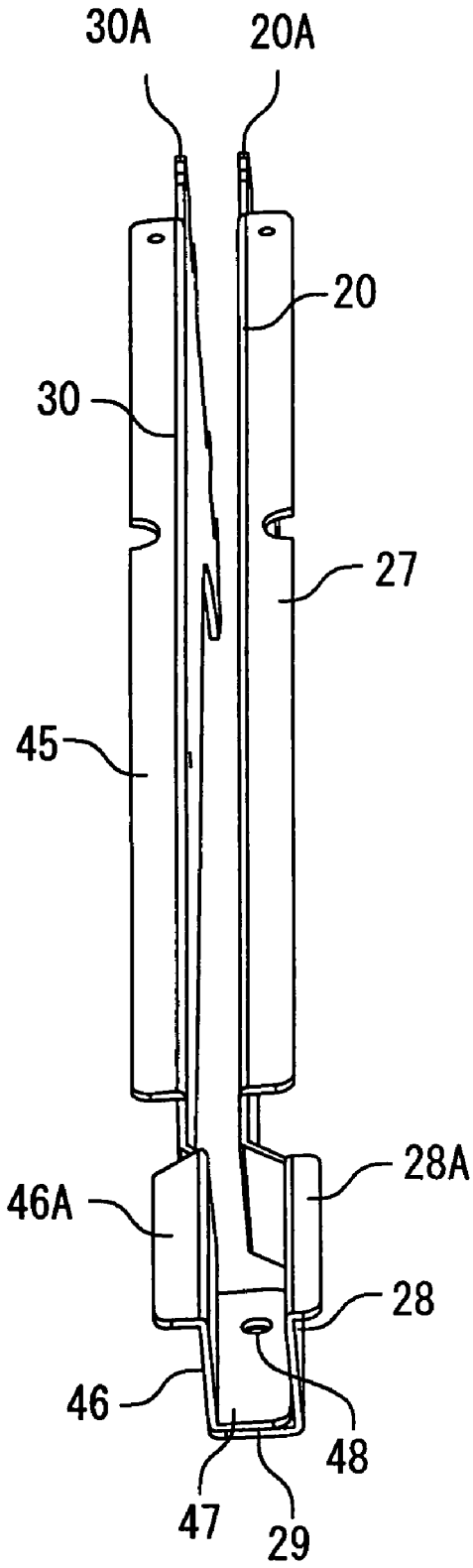
FIG. 8 is a perspective view showing a state in which the first shelf support member is superimposed on the second shelf support member.
Figure 9:
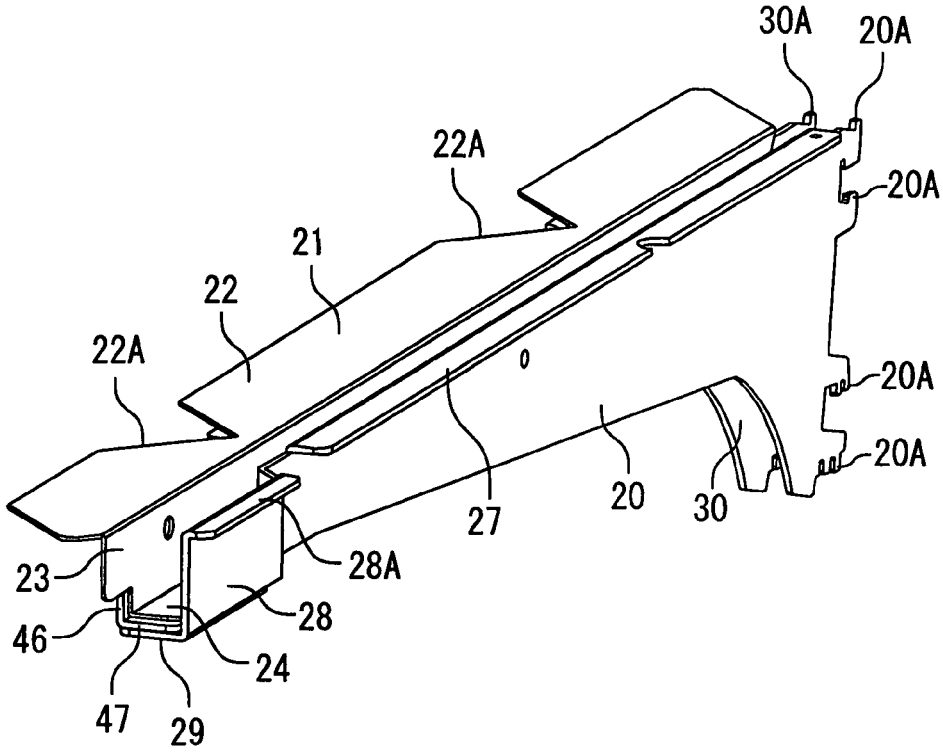
FIG. 9 is a perspective view showing a state in which a first shelf side superimposed portion of the shelf side plate constituting a first shelf plate is superimposed in addition to the state of FIG. 8.
Figure 10:
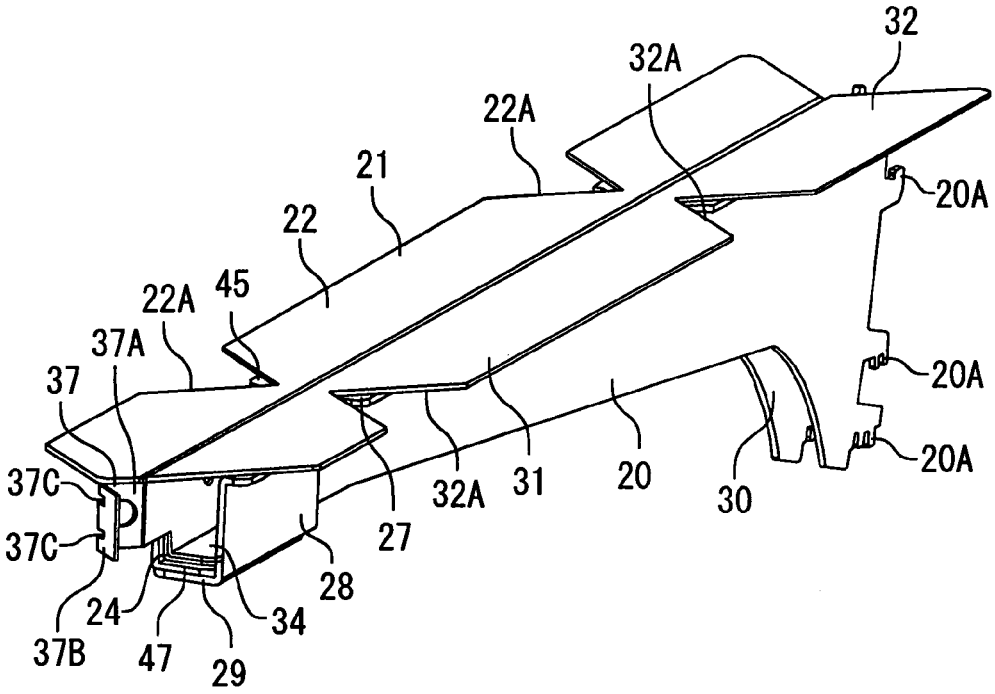
FIG. 10 is a perspective view showing a state in which a second shelf side superimposed portion of the shelf side plate constituting a second shelf plate is superimposed in addition to the state of FIG. 9.
Figure 11:
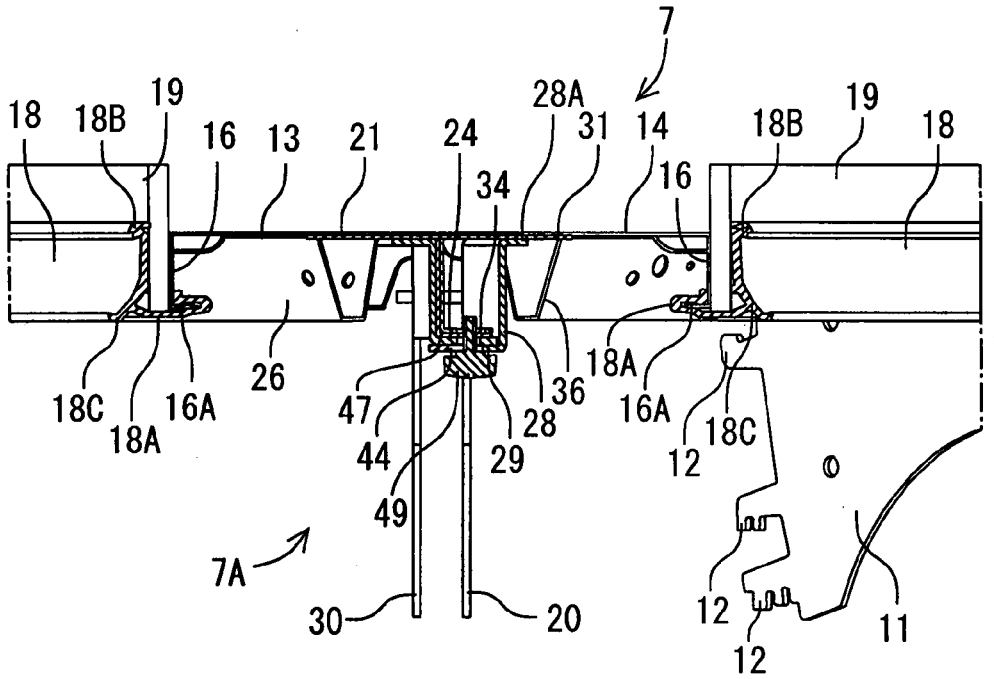
FIG. 11 is a vertically sectional view of the shelf device of FIG. 3.
Figure 12:
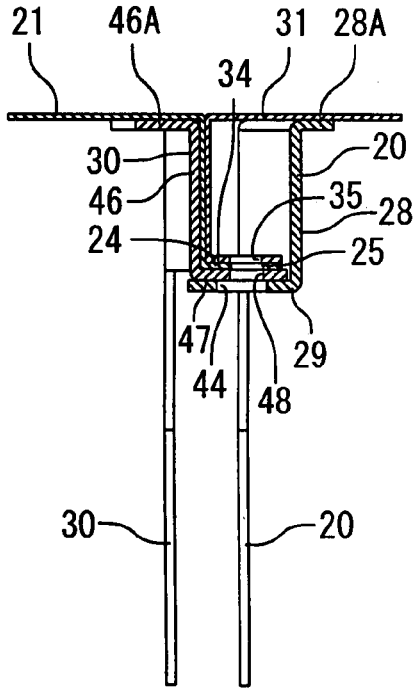
FIG. 12 is an enlarged sectional view showing superimpositions of the superimposed portions.
Figure 13:
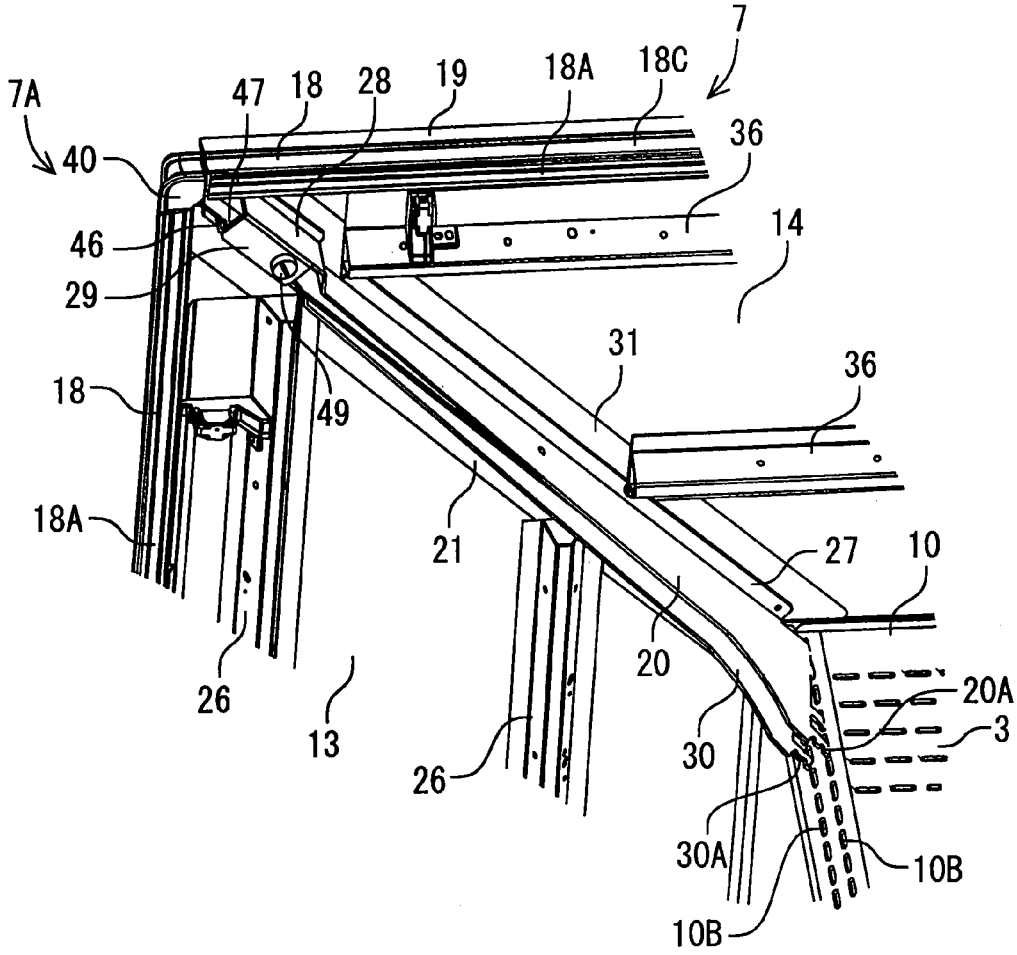
FIG. 13 is a perspective view of the shelf device viewed from below.
Figure 14:
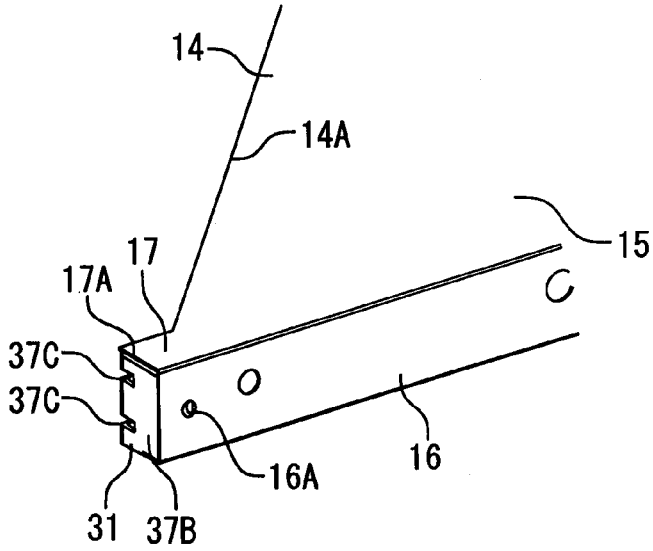
FIG. 14 is a perspective view of a second shelf plate.
Figure 15:
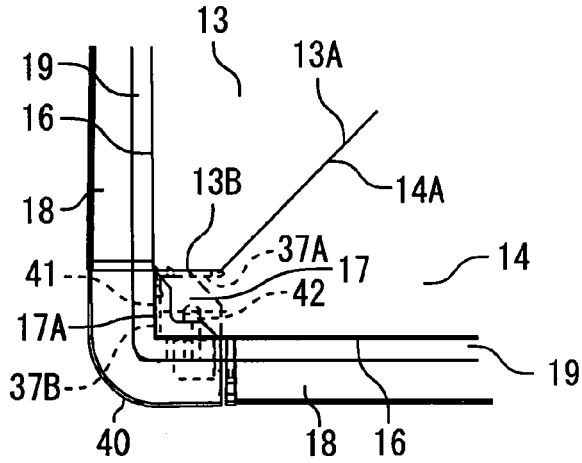
FIG. 15 is a partially enlarged see-through plan view of a corner portion of the shelf device.
Figure 16:
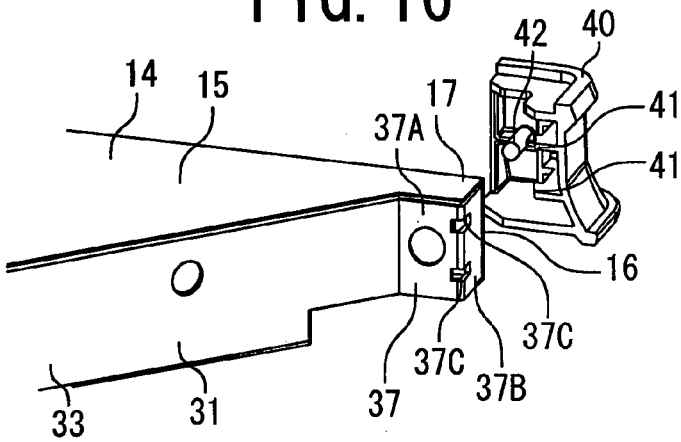
FIG. 16 is a partially enlarged perspective view of the second shelf plate and a corner decoration.
Figure 17:
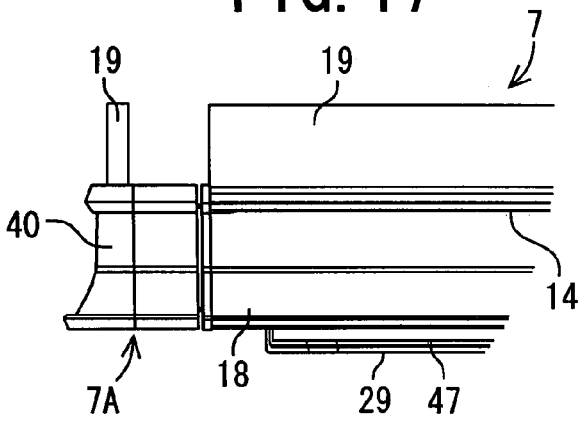
FIG. 17 is a partially side view of a corner portion of the shelf device.

Hereinafter, a constitution of each shelf device 7, especially a structure of the corner portion of the shelf device 7 will be described with reference to FIGS. 3 to 17. FIG. 3 is a partially enlarged perspective view of the corner portion of the shelf device 7; FIG. 4 is a perspective view of a first shelf side plate 21; FIG. 5 is a perspective view of a second shelf side plate 31; FIG. 6 is a perspective view of the first shelf support member 20; FIG. 7 is a perspective view of the second shelf support member 30; FIG. 8 is a perspective view showing a state in which the first shelf support member 20 is superimposed on the second shelf support member 30; FIG. 9 is a perspective view showing a state in which a first shelf side superimposed portion 24 of the shelf side plate 21 constituting a first shelf plate 13 is superimposed in addition to the state of FIG. 8; FIG. 10 is a perspective view showing a state in which a second shelf side superimposed portion 34 of the shelf side plate 31 constituting a second shelf plate 14 is superimposed in addition to the state of FIG. 9; FIG. 11 is a vertically sectional view of the shelf device 7 of FIG. 3; FIG. 12 is an enlarged sectional view showing superimpositions of the superimposed portions; FIG. 13 is a perspective view of the shelf device 7 viewed from below; FIG. 14 is a perspective view of the second shelf plate 14; FIG. 15 is a partially enlarged see-through plan view of a corner portion of the shelf device 7; FIG. 16 is a partially enlarged perspective view of the second shelf plate 14 and a corner decoration 40; and FIG. 17 is a partially side view of the corner portion 7A of the shelf device 7.

Since the shelf devices 7 to be installed in the showroom 6 are attached to the vertical structure 3 in two or four open surfaces, the devices are constituted of shelf plates arranged in the surfaces, and the shelf support members 11, 20 and 30 for installing and supporting these shelf plates. It is to be noted that one of the shelf plates arranged adjacent to each other is the shelf plate 13 (the first shelf plate) and the other plate is the shelf plate 14 (the second shelf plate).

Since the shelf plates 13, 14 are attached over two or four surfaces, butted end surfaces 13A, 14A of the shelf plates 13, 14 arranged adjacent to each other are inclined at a predetermined angle to the vertical structure 3 or an outer end formed in parallel with the vertical structure 3. In the present embodiment, since both the butted shelf plates 13, 14 have an equal inclination angle, the end surfaces are inclined so as to form an angle of about 135° with respect to the outer surface of the vertical structure 3 and an angle of about 45° with respect to the outer ends of the shelf plates 13, 14 formed in parallel with the vertical structure 3.

The shelf plates 13, 14 are formed of a steel plate material, and each of the plates is provided with a mounting surface 15 on which the commodities are mounted; and a rear wall and a front wall 16 (the end surface) which are formed by bending downwards an end portion of the mounting surface on a vertical structure 3 side and a customer side. Moreover, the shelf side plate (the first shelf side plate) 21 is attached to a side end of the shelf plate 13 extending in a depth direction on an end surface 13A side butted with the second shelf plate 14. The shelf side plate (the second shelf side plate) 31 is attached to a side end of the shelf plate 14 extending in the depth direction on an end surface 14A side butted with the first shelf plate 13. It is to be noted that a shelf side plate (not shown) substantially formed into an L-shaped sectional shape is attached to a side end of the second shelf plate 14 positioned on the other side.

As shown in FIG. 4, the first shelf side plate 21 is a steel plate member bent and formed into a substantially L-shaped sectional shape, and the plate is constituted of a fixed surface 22 fixed to the side end of the first shelf plate 13 by spot welding or the like; and a side surface 23 formed by bending, downwards substantially at right angles, an end portion of the fixed surface 22 positioned on the side of the end surface 13A of the shelf plate 13. A front portion of this side surface 23 is provided with the shelf side superimposed portion 24 (a first shelf side superimposed portion) having a lower end bent substantially at right angles on a side opposite to a side provided with the fixed surface 22, that is, on the side of the end surface 14A of the shelf plate 14 butted with the end surface 13A of the shelf plate 13 in a state in which the shelf side plate 21 is attached to the shelf plate 13. In consequence, it is assumed that a side formed as a stage from the end surface 13A of the first shelf plate 13 in the form of stairs to constitute a bottom side of the stairs at a time when the shelf side plate 21 is attached to the shelf plate 13 is the shelf side superimposed portion 24. Moreover, this shelf side superimposed portion 24 is provided with a bonding member insertion hole 25 which is vertically extended. It is to be noted that two cutouts 22A, 22A formed in the fixed surface 22 are cutouts which avoid reinforcing members 26, 26 attached to a lower surface of the shelf plate 13 to which the shelf side plate 21 is fixed.

As shown in FIG. 5, the second shelf side plate 31 is a steel plate member bent and formed into a substantially L-shaped sectional shape, and the plate is constituted of a fixed surface 32 fixed to the side end of the second shelf plate 14 by spot welding or the like; and a side surface 33 formed by bending, downwards substantially at right angles, an end portion of the fixed surface 32 positioned on the side of the end surface 14A of the shelf plate 14. A front portion of this side surface 33 is provided with the shelf side superimposed portion 34 (the second shelf side superimposed portion) having a lower end bent substantially at right angles on a side provided with the fixed surface 32. In consequence, it is assumed that a side turned downwards from the end surface 14A of the shelf plate 14 to constitute a turned bottom side at a time when the shelf side plate 31 is attached to the shelf plate 14 is the shelf side superimposed portion 34. Moreover, this shelf side superimposed portion 34 is provided with a bonding member insertion hole 35 which is vertically extended. It is to be noted that two cutouts 32A, 32A formed in the fixed surface 32 are cutouts which avoid reinforcing members 36, 36 attached to a lower surface of the shelf plate 14 to which the shelf side plate 31 is fixed.

Moreover, at a front end of the side surface 33 of this shelf side plate 31, an extending portion constituting piece 37 is formed which constitutes the corner portion 7A together with an extending portion 17 formed on the shelf plate 14 described later in detail. This extending portion constituting piece 37 is bent along an end surface of the extending portion 17, and is integrally formed by continuously constituting an extending portion rear surface 37A substantially formed in parallel with the front wall 16 of the shelf plate 14 and an extending portion side surface 37B formed by substantially bending at right angles a front end of the extending portion rear surface 37A in such a direction that the front end comes close to an end surface of the front wall 16 of the shelf plate 14.

In consequence, when the shelf side plate 31 is attached to the shelf plate 14, the extending portion constituting piece 37 abuts on a lower surface of the extending portion 17 formed on the shelf plate 14. A rear surface of the extending portion 17 facing the shelf plate 13 and a side surface of the extending portion 17 having substantially the same plane as that of the front wall 16 of the first shelf plate 13 are formed. It is to be noted that at a corner portion where these extending portion rear surface 37A is butted with the extending portion side surface 37B, cutouts 37C, 37C are formed. The cutouts 37C are disengageably engaged with auxiliary engagement pieces 41 formed on the corner decoration 40 described later.

Moreover, as described above, the shelf plate 13 to which the shelf side plate 21 is attached is supported by the shelf support member 30 (the second shelf support member) and engaged with the back plate 10. Moreover, the shelf plate 14 to which the shelf side plate 31 is attached is supported by the shelf support member 20 (the first shelf support member) and engaged with the back plate 10.

Here, as shown in FIG. 6, the shelf support member 20 to install and support the shelf plate 14 is a steel plate member extended in the depth direction along the side end (the end surface 14A) of the shelf plate 14. At the rear end of the shelf support member, a plurality of engagement claws 20A are formed which are disengageably engaged with the engagement holes 10B formed in the corner attachment surface 10A of the back plate 10. At an upper end of this shelf support member 20, a shelf support surface 27 is formed which is bent substantially at right angles toward the shelf plate 14 to support the shelf plate 14 and the shelf side plate 31 constituting the shelf plate 14.

Furthermore, a front end of this shelf support member 20 is bent toward the shelf plate 14 at a predetermined angle, and then bent again substantially in parallel with the shelf side plate 31 to form a shelf support member front portion 28. A lower end of the shelf support member front portion 28 is bent substantially at right angles toward the shelf side plate 21 of the other shelf plate 13 to form a (first) support member side superimposed portion 29. In consequence, the support member side superimposed portion 29 is formed so as to protrude toward the shelf side plate 21 of the other shelf plate 13 and the shelf support member 30 which supports the shelf plate 13. Moreover, this support member side superimposed portion 29 is provided with a vertically extending bonding member insertion hole 44. It is to be noted that an upper end of the shelf support member front portion 28 is also bent substantially at right angles toward the shelf plate 14 to form a shelf support surface 28A which supports the shelf plate 14 and the shelf side plate 31 constituting the shelf plate 14.

On the other hand, as shown in FIG. 7, the shelf support member 30 to install and support the shelf plate 13 is a steel plate member extended in the depth direction along the side end (the end surface 13A) of the shelf plate 13. At the rear end of the shelf support member, a plurality of engagement claws 30A are formed which are disengageably engaged with the engagement holes 10B formed in the corner attachment surface 10A of the back plate 10. At an upper end of this shelf support member 30, a shelf support surface 45 is formed which is bent substantially at right angles toward the shelf plate 13 to support the shelf plate 13 and the shelf side plate 21 constituting the shelf plate 13.

Furthermore, a front end of this shelf support member 30 is bent toward the shelf plate 14 at a predetermined angle, and then bent again substantially in parallel with the shelf side plate 21 to form a shelf support member front portion 46. A lower end of the shelf support member front portion 46 is bent substantially at right angles toward the shelf side plate 31 of the other shelf plate 14 to form a (second) support member side superimposed portion 47. In consequence, the support member side superimposed portion 47 is formed so as to protrude toward the shelf side plate 31 of the other shelf plate 14 and the shelf support member 20 which supports the shelf plate 14. Moreover, this support member side superimposed portion 47 is provided with a vertically extending bonding member insertion hole 48. It is to be noted that an upper end of the shelf support member front portion 46 is also bent substantially at right angles toward the shelf plate 13 to form a shelf support surface 46A which supports the shelf plate 13 and the shelf side plate 21 constituting the shelf plate 13.

It is to be noted that as described above, the first shelf side superimposed portion 24 of the shelf side plate 21 constituting the first shelf plate 13, the second shelf side superimposed portion 34 of the shelf side plate 31 constituting the shelf plate 14, the second support member side superimposed portion 47 of the first shelf support member 30 to install and support the first shelf plate 13 and the first support member side superimposed portion 29 of the second shelf support member 20 to install and support the second shelf plate 14 are integrated and bonded at one portion, that is, under the corner portion 7A of the shelf device 7 in the present embodiment. These superimposed portions have a constitution in which the first support member side superimposed portion 29, the second support member side superimposed portion 47, the first shelf side superimposed portion 24 and the second shelf side superimposed portion 34 are superimposed on one another in order from below.

That is, among these four superimposed portions, the first support member side superimposed portion 29 is formed to be lowest and have a large width dimension. Next, the second support member side superimposed portion 47 is formed to be low and have a large width dimension which is smaller than the width dimension of the first support member side superimposed portion 29. The first shelf side superimposed portion 24 is formed so that the portion can be superimposed on the second support member side superimposed portion 47 from above. Moreover, the shelf support member front portion 46 of the shelf support member 30 provided with the support member side superimposed portion 47 is brought into close contact with the front portion of the side surface 23 of the shelf side plate 21 provided with the first shelf side superimposed portion 24 over a front to rear direction. Furthermore, the second shelf side superimposed portion 34 is formed so that the portion can be superimposed on the first shelf side superimposed portion 24 from above. Moreover, the side surface 33 of the shelf side plate 31 provided with the second shelf side superimposed portion 34 can abut on or come close to the side surface 23 of the shelf side plate 21 provided with the first shelf side superimposed portion 24.

Furthermore, the bonding member insertion holes 25, 35, 48 and 44 formed in the superimposed portions are all formed in a position where the superimposing is possible.

According to the above constitution, when the shelf plates 13, 14 constituting the shelf device 7 are installed, first the engagement claws 20A, 30A of the shelf support members 20, 30 are engaged with the engagement holes 10B formed in the corner attachment surface 10A of the back plate 10, respectively. At this time, the corner attachment surface 10A is provided with at least two rows of engagement holes 10B over the vertical direction, one of the rows is engaged with the first shelf support member 30 to install and support the first shelf plate 13, and the other row is engaged with the second shelf support member 20 to install and support the second shelf plate 14. It is to be noted that in the present embodiment, as shown in FIG. 2, the first shelf plate 13 is installed on the left side as one faces the drawing, and the second shelf plate 14 is installed on the right side as one faces the drawing. Therefore, the first shelf support member 30 is installed along the row of engagement holes 10C formed on the left side of the engagement holes 10B formed in the corner attachment surface 10A, and the second shelf support member 20 is installed along the row of the engagement holes 10C formed on the right side as one faces the drawing.

In consequence, since the support member side superimposed portions 29, 47 are formed at front portions of the shelf support members 20, 30, the support member side superimposed portion 47 formed at the front portion of the first shelf support member 30 is superimposed on an upper surface of the support member side superimposed portion 29 formed at the front portion of the second shelf support member 20 (FIG. 8). It is to be noted that the superimposed portions 29, 47 to be superimposed are formed between the first shelf support member 30 and the second shelf support member 20 in this state. Therefore, a gap having a predetermined interval is formed in the depth direction.

Subsequently, the first shelf plate 13 is mounted from above the first shelf support member 30. It is to be noted that an end portion of the shelf plate 13 which is not supported by the shelf support member 30 is installed and supported with the shelf support member 11. At this time, the shelf side plate 21 is disposed on the end surface 13A of the shelf plate 13 which is butted with the shelf plate 14. Therefore, the first shelf side superimposed portion 24 of the shelf side plate 21 is superimposed on an upper surface of the support member side superimposed portion 47 of the first shelf support member 30 (FIG. 9). It is to be noted that at this time, the shelf support member front portion 46 of the shelf support member 30 provided with the support member side superimposed portion 47 and the front portion of the side surface 23 of the shelf side plate 21 provided with the first shelf side superimposed portion 24 are brought into close contact with each other forwards and backwards. Therefore, the shelf side plate 21 is stably supported by the shelf support member 30. The side surface 23 of the shelf side plate 21 is stored in the gap between the shelf support members 20 and 30 in the depth direction, and does not obstruct the installation. In consequence, when the first shelf plate 13 is simply mounted, the first shelf plate can stably be installed and supported with the first shelf support member 30 and the other shelf support member 11.

Next, the second shelf plate 14 is mounted from above the second shelf support member 20. It is to be noted that an end portion of the shelf plate 14 which is not supported by the shelf support member 20 is installed and supported with the shelf support member 11. At this time, the shelf side plate 31 is disposed on the end surface 14A of the shelf plate 14 which is butted with the shelf plate 13. Therefore, the second shelf side superimposed portion 34 of the shelf side plate 31 is superimposed on an upper surface of the first shelf side superimposed portion 24 (FIG. 10).

Here, since the shelf side superimposed portion 34 is turned downwards from the end surface 14A of the shelf plate 14, a superimposed surface constituted by superimposing the superimposed portions 29, 47, 24 and 34 is covered with the mounting surface 15 of the shelf plate 14 provided with the shelf side plate 31. Since the side surface 23 of the shelf side plate 21 abuts on or comes close to the side surface 33 of the shelf side plate 31, the mounting surface 15 of the shelf plate 13 is substantially formed in the same plane as that of the mounting surface 15 of the shelf plate 14 without any step. In consequence, the corner portion 7A of the shelf device 7 formed by the first shelf plate 13 and the second shelf plate 14 can be flattened. Improvements of display performance and appearance can be realized.

It is to be noted that in this case, the side surface 33 of the shelf side plate 31 is stored in the gap formed between the shelf support members 20 and 30 in the depth direction, and does not obstruct the installation. In consequence, when the second shelf plate 14 is simply mounted, the second shelf plate can stably be installed and supported with the second shelf support member 20 and the other shelf support member 11.

According to such a constitution, the first support member side superimposed portion 29 and the second support member side superimposed portion 47 are mounted on each other, the shelf side superimposed portion 24 of the first shelf plate 13 is further mounted on the shelf support member 30 provided with the support member side superimposed portion 47, and the shelf side superimposed portion 34 of the second shelf plate 14 to be installed and supported with the shelf support member 20 provided with the support member side superimposed portion 29 is mounted on the shelf side superimposed portion 24. In consequence, the shelves 13, 14 and the support members 20, 30 are bonded. Therefore, positioning and attaching/detaching are facilitated.

Especially, when the superimposed portions 29, 47 formed on the shelf support members 20, 30 are mounted on each other, the shelf support members 20, 30 can securely and stably be bonded. In such a state, when the superimposed portions 24, 34 of the shelf plates 13, 14 are simply mounted on the superimposed portions 29, 47 formed on the shelf support members 20, 30, the front end portions of the shelf plates 13, 14 can securely be supported by the shelf support members 20, 30. Especially, since these superimposed portions 29, 47, 24 and 34 are superimposed integrally on one place, it is possible to stably attach the shelf support members 20, 30 and the shelf plates 13, 14 by the engagement with the engagement holes 10B formed in the corner attachment surface 10A of the back plate 10.

Therefore, even when the commodities on the shelf are mounted on the front sides of the shelf plates 13, 14 in a concentrated manner and loads are concentrated on distal ends of the shelf plates 13, 14, it is possible to eliminate disadvantages that the rear ends of the shelf plates 13, 14 move upwards, the shelf support members 20, 30 disengage from the engagement holes 10B of the back plate 10 and the members fall together with the shelf plates 13, 14. In consequence, reliability of the shelf can be improved.

Moreover, since the bonding member insertion holes 25, 35, 48 and 44 formed in the superimposed portions 29, 47, 24 and 34 are all formed in the position where the superimposed portions can be superimposed, a bonding member 49 is inserted into the bonding member insertion holes 25, 35, 48 and 44 from below the superimposed portions, and fixed.

In consequence, since all the superimposed portions 29, 47, 24 and 34 are detachably bonded with one bonding member 49, the shelf plates 13, 14 can more stably and securely be installed. Since the superimposed portions 29, 47, 24 and 34 are constituted of the front portions of the shelf support members 20, 30 and the shelf side plates 21, 31, a bonding operation by use of the bonding portion 48 can easily be performed.

On the other hand, as shown in FIGS. 14 and 15, the extending portion 17 extending toward a distal end of the end surface 13A of the first shelf plate 13 is formed at a distal end portion of the second shelf plate 14 which is butted with the end surface 13A of the first shelf plate 13. This extending portion 17 constitutes the corner portion 7A of the shelf device 7 together with the extending portion constituting piece 37 formed on the side surface 33 of the shelf side plate 31. The extending portion is formed so as to form an obtuse angle with the end surface 14A at a distal end portion of the end surface 14A of the second shelf plate 14 on a butted side. Moreover, the extending portion is formed substantially in parallel with the front wall 16 of the second shelf plate 14, and a distal end surface 17A of the extending portion 17 is constituted so as to cross the front wall 16 of the second shelf plate 14 substantially at right angles. In consequence, the distal end surface of the extending portion 17 substantially has the same plane as that of the front wall 16 of the first shelf plate 13.

Moreover, a front wall end portion of the extending portion 17 constituted continuously from the front wall 16 of the second shelf plate 14 is provided with an engagement hole 16A through which an engagement portion 42 of the corner decoration 40 described later can disengageably be inserted.

On the other hand, a distal end portion 13B of the end surface 13A of the first shelf plate 13 on a side on which the end surface is butted with the end surface 14A of the second shelf plate 14 is formed so as to abut on the extending portion 17 formed continuously from the end surface 14A of the second shelf plate 14. Moreover, the distal end portion is formed substantially in parallel with the front wall 16 of the second shelf plate 14 in the same manner as in the extending portion 17.

In consequence, when the end surfaces 13A, 14A of the first shelf plate 13 and the second shelf plate 14 are butted with each other, an abutment operation of the end surfaces 13A, 14A can easily be performed by use of the extending portion 17 formed on the second shelf plate 14 and the distal end portion 13B formed on the first shelf plate 13. The corner portion 7A formed by abutting the end surfaces 13A, 14A of the shelf plates 13, 14 with each other is constituted of one member, that is, the extending portion 17 formed on the shelf plate 14. Therefore, as compared with two shelves are butted with each other to thereby constitute the corner portion of the distal end portion, a dimensional error is not easily generated, and attachment operability of the shelf plate is improved.

It is to be noted that on the extending portion 17 formed on the shelf plate 14, the extending portion constituting piece 37 of the shelf side plate 31 attached to the shelf plate 14 as described above forms a rear surface (the extending portion rear surface 37A) which faces the extending portion 17 on the shelf plate 13 side, and forms a side surface (the extending portion side surface 37B) substantially having the same plane as the front wall 16 of the shelf plate 13.

On the other hand, linear shelf decorations 18 to which display cards are to be attached are mounted on the front walls 16 formed on end surfaces of the shelf plates 13, 14 on a side opposite to the vertical structure 3. On the display cards, prices and product names of the display commodities displayed on the shelf device 7 are displayed. Moreover, a guard 19 positioned between this shelf decoration and the front wall 16 to prevent falling of the display commodities is inserted and vertically disposed on an inner side of the shelf decoration 18.

This shelf decoration 18 is molded of a hard synthetic resin, aluminum or the like. As shown in FIG. 11, the shelf decoration is constituted of a rear lower attachment portion 18A, a front upper pressing portion 18B and a holding portion 18C disposed under the pressing portion. The attachment portion 18A is engaged with a flange 16A formed at a lower end of the front wall 16 of the shelf plate 13 or 14 to attach the shelf decoration 18 to the shelf plate 13 or 14.

In this state, the pressing portion 18B faces the front wall 16 of the shelf plate at an interval, and the guard 19 is inserted into the interval from above, and vertically disposed. The holding portion 18C has a circular section which is sunken on a shelf plate 13 or 14 side, and the display card (not shown) is inserted and held between grooves formed at upper and lower ends of a front surface of this holding portion 18C.

Moreover, the corner decoration 40 is attached to the corner portion 7A where these shelf decorations 18 are butted with each other. This corner decoration 40 has a sectional shape substantially similar to that of the shelf decoration 18, and is molded of a hard synthetic resin, aluminum or the like in the same manner as in the shelf decoration 18.

This corner decoration 40 has an end surface which faces end surfaces of both the shelf decorations 18 crossing each other at right angles, and is provided with the engagement portion 42 which protrudes toward the front wall 16 of the shelf plate 14 to which the corner decoration 40 is attached. On one end surface of the corner decoration 40, that is, the end surface of the corner decoration facing the shelf decoration 18 disposed on the front wall 16 of the shelf plate 13 in the present embodiment, the auxiliary engagement pieces 41 are formed. The auxiliary engagement pieces protrude in substantially the same direction as that of the front wall 16 of the second shelf plate 14, and actually protrude toward the extending portion side surface 37B formed substantially in the same plane as that of the front wall 16 of the shelf plate 14.

According to such a constitution, in a state in which the shelf decorations 18, 18 are attached to the front walls 16 of the shelf plates 13, 14, the corner decoration 40 is attached to the extending portion 17 constituting the corner portion 7A of the shelf plate 14. At this time, the engagement portion 42 of the corner decoration 40 is inserted into the engagement hole 16A formed in the front wall end portion of the extending portion 17 to engage the corner decoration. The auxiliary engagement pieces 41 of the corner decoration 40 are auxiliarily engaged with the cutouts 37C formed in the corner portion where the extending portion rear surface 37A and the extending portion side surface 37B which constitute the extending portion 17 are butted with each other.

In consequence, in a state in which the opposite end surfaces of the corner decoration 40 abut on or come close to the end surfaces of the shelf decorations 18, 18 attached to the front walls 16 of the shelf plates 13, 14, the corner decoration is attached to the corner portion 7A of the shelf device 7.

At this time, the extending portion 17 to which the corner decoration 40 is attached is formed on one shelf plate 14. Therefore, an operation during the attaching of the corner decoration 40 can easily be performed. Especially, in a conventional shelf constitution, the corner portion has been formed by butting the distal end portions of the shelf plates 13, 14 with each other. It has therefore been difficult to precisely match the butted position of the distal end portions during installing of the shelves, the attaching operation of the corner decoration has been laborious, and the decoration has easily been disengaged. However, according to the present constitution, the corner decoration 40 is attached to one shelf plate 14. Therefore, the corner decoration 40 can be attached without being influenced by the positioning of the shelf plates 13, 14. In consequence, even in a case where those who move in the vicinity of the shelf devices 7 come into contact with the corner decoration 40, the decoration does not easily fall. It is possible to inhibit a disadvantage that the corner decoration 40 is lost.

It is to be noted that in the present embodiment, the opposite end surfaces of the corner decoration 40 are attached in a state in which the surfaces abut on or come close to the end surfaces of the shelf decorations 18, 18 attached to the front walls 16 of the shelf plates 13, 14, but the present invention is not limited to the constitution. For example, one or both of the end surfaces of the corner decoration may be inserted and superimposed between the shelf decoration 18 and the shelf plate front wall 16.

What is claimed is:

1. A showcase provided with adjacent shelves in a chamber having a plurality of open surfaces, the showcase comprising:

a pair of adjacent shelf support members which extend in a depth direction of the chamber and which support the adjacent shelves in a position where the adjacent shelves are butted with each other, respectively;

a first support member side portion arranged to protrude from a lower portion of a front portion of one shelf support member to the other shelf support member;

a second support member side-portion arranged to protrude from a lower portion of a front portion of the other shelf support member to the one shelf support member and which is superimposed on the first support member side portion;

a pair of adjacent side plates supported by the shelf support members;

a first shelf side portion which is formed from an edge portion of a front portion of one shelf side plate and which has a bottom side superimposed on the second support member side portion;

a second shelf side portion which is turned downwards from an edge portion of a front portion of the other shelf side plate and which has a bottom side superimposed on the first shelf side portion;

wherein the first support member side portion is formed to be lowest and have a width direction, the second support member side portion, and a bonding member detachably bonding the first support member side portion, second support member side portion, first shelf side portion and second shelf side portion in superimposed position.

2. The showcase according to claim 1, wherein one of the pair of shelf support members supports one shelf of the adjacent shelves and the other shelf support member supports the other adjacent shelf.

3. A showcase according to claim 1, including:

a shelf decoration mounted on a front wall formed on an end surface of a shelf of the adjacent shelves having a rear lower attachment portion, a first upper pressing portion and a holding portion disposed under the pressing portion, the attachment portion engaged with a flange formed at a lower end of the front wall, wherein the attachment portion attaches the shelf decoration to the shelf of the adjacent shelves, the pressing portion faces the front wall of the shelf of the adjacent shelves, and the holding portion has a front surface with upper and lower ends arranged to hold a display card; and a corner decoration which is positioned at a corner portion where each of two adjacent shelves are butted with each other and which is disposed between the adjacent shelf decorations, wherein an extending portion on the shelf of the adjacent shelves which extends toward an abutted shelf of the adjacent shelves to constitute the corner portion is formed at a butted side distal end portion of one of the adjacent shelves; and the corner decoration is attached to the extending portion.

* * * * *